US008091893B2

(12) United States Patent
Whitaker

(10) Patent No.: US 8,091,893 B2
(45) Date of Patent: Jan. 10, 2012

(54) FOOD PREP BOARD GAME

(76) Inventor: Robert L. Whitaker, Crestwood, KY (US)

( * ) Notice: Subject to any disclaimer, the term of this patent is extended or adjusted under 35 U.S.C. 154(b) by 0 days.

(21) Appl. No.: 12/802,376

(22) Filed: Jun. 7, 2010

(65) Prior Publication Data

US 2011/0298180 A1 Dec. 8, 2011

(51) Int. Cl.
*A63F 3/00* (2006.01)

(52) U.S. Cl. ..... 273/242; 273/288

(58) Field of Classification Search ..... 273/242, 273/288, 289, 290, 291
See application file for complete search history.

(56) References Cited

U.S. PATENT DOCUMENTS

| | | | | |
|---|---|---|---|---|
| 2,391,147 | A * | 12/1945 | Fredriksson | 273/258 |
| 3,888,490 | A * | 6/1975 | Kline | 273/243 |
| 4,003,577 | A * | 1/1977 | Bolach | 273/243 |
| 4,529,205 | A | 7/1985 | Bowker | |
| 4,730,831 | A * | 3/1988 | De Sio | 273/243 |
| 4,948,146 | A | 8/1990 | Snyder et al. | |
| 5,676,369 | A | 10/1997 | DeWeese | |
| 6,315,292 | B1 | 11/2001 | Howlett et al. | |
| 6,755,418 | B1 | 6/2004 | Jackson | |
| 6,974,131 | B2 | 12/2005 | Frank | |
| 7,044,466 | B2 | 5/2006 | Laibson et al. | |
| 2005/0116413 | A1 * | 6/2005 | Wagner | 273/242 |
| 2010/0025930 | A1 * | 2/2010 | Rank et al. | 273/236 |

* cited by examiner

*Primary Examiner* — Vishu Mendiratta
(74) *Attorney, Agent, or Firm* — Carrithers Law Office, PLLC

(57) ABSTRACT

A board game containing a board with multicolored squares laid out in a rectangular path and playing pieces to which specialized pieces are added connected as the player advances the playing piece around the board. The specialized pieces to be added to the playing piece represent and look like one of the following: a piece of bread, peanut butter, or jelly. The object of the game is to build a peanut butter and jelly sandwich and advance the sandwich to a space which represents a glass of milk. A player rolls a die, and advances a playing piece the number of spaces on the die. There are spaces of many different colors. Purple corresponds to jelly, yellow corresponds to a piece of bread and brown corresponds to peanut butter. Spaces of other colors don't have a special meaning. If a player lands on purple, yellow or brown and if the player needs the piece corresponding to that color, then that piece is joined to the player's playing piece. When the player has completed a peanut butter and jelly sandwich, that player's piece must advance around the path to an exit lane and then the player must roll the exact number that causes the playing piece to land on the winning space which corresponds to a glass of milk. The game is intended for ages four and up.

6 Claims, 3 Drawing Sheets

FOOD PREP BOARD GAME

BACKGROUND OF THE INVENTION

1. Technical Field

The present invention relates to the field of board games using playing pieces which are advanced around the board to a target space based on the roll of a die.

2. Description of the Related Art

Board games using a board with spaces forming a course around which playing pieces are advanced based on the roll of a die are well know in the art. Such a game which requires the player to build a facsimile of a peanut butter and jelly sandwich on the playing piece based on movement of the playing piece around the board is not known to the applicant.

SUMMARY OF THE INVENTION

The present invention provides a board game and a method of playing a game involving two or more players taking turns rolling a die, advancing a playing piece around the spaces of the board and building a peanut butter and jelly sandwich by assembling special pieces onto the playing piece based on the color of the spaces on which the playing piece lands. The winner is the first person to complete a peanut butter and jelly sandwich on that player's playing piece and advance that playing piece onto a spot that corresponds to a glass of milk. However, alternate embodiments of the game may be built around hamburger sandwiches with typical hamburger sandwich ingredients, or pizzas with typical pizza ingredients, or other prepared food items.

This invention provides amusement and competition for players young and old, including players too young to read but old enough to count. Families with young children who are learning to count can use this game to teach and reinforce the act of counting in young learners while having fun doing so.

More particularly, the present invention provides a board game comprising or consisting essentially of a board with squares of different colors laid out in a rectangular path and playing pieces to which specialized pieces are connected to the playing piece as the player advances around the board. The specialized pieces to be added to the playing piece represent and look like one of the following: a piece of bread, peanut butter, or jelly. The object of the game is to build a peanut butter and jelly sandwich. A player rolls a die, and advances a playing piece by the number of spaces that appear on the top of the die. The color of the space on which the playing piece lands corresponds to a particular specialized piece. If the player needs that piece, then that piece is added to the player's playing piece. The specialized pieces must be added to the playing piece in the proper order, that is, first, a piece of bread, second, a layer of peanut butter, third, a layer of jelly and fourth, a piece of bread. Finally, the player must then advance the playing piece, to which a complete peanut butter and jelly sandwich is now attached, to an exit path and then land directly on a space which represents a glass of milk.

The playing piece has a base with a cylindrical longitudinal member extending vertically from the center of the base. The playing piece is placed on the base with the longitudinal member standing vertically upward. The specialized pieces are shaped like pieces of bread, a layer of peanut butter or a layer of jelly. Each of these pieces has an aperture formed in the center. When the playing piece lands on a yellow space, a piece of bread may be slipped down over the longitudinal member and onto the base. A brown space corresponds to peanut butter and a purple space corresponds to jelly. When the player has built a peanut butter and jelly sandwich, that player's piece must move to an exit lane and then the player must roll the exact number that causes the playing piece to land on the winning space which corresponds to a glass of milk. The first player to land a completed sandwich on the glass of milk is the winner. The game is intended for ages four and up.

In accordance with the present invention, there is provided a peanut butter and jelly with milk board game comprising, consisting of, or consisting essentially of a game board having a rectangular path of colored spaces including color coded spaces and non-color coded spaces, a start space and a winner's space shaped and colored to resemble a glass of milk. The board includes holding areas for specialized pieces representing sandwich parts, and an exit path leading to the winner's space. The board game further includes six playing pieces, each of which includes a disc shaped base member and a cylindrical longitudinal member extending coaxially upward from the center of the base member. The diameter of the cylindrical member is approximately one fourth the diameter of the disc shaped base member and the disc shaped member has a thickness of between one eighth and one fourth of the diameter of the disc. Also included are first specialized pieces representing pieces of bread which are shaped like a piece of sandwich bread and have a circular aperture in the center. The diameter of the aperture in the first specialized pieces is slightly larger than the diameter of the cylindrical longitudinal member. Further, second specialized pieces represent layers of peanut butter, are shaped like a layer of peanut butter spread onto a piece of sandwich bread and also have a circular aperture in the center. The diameter of the aperture in the second specialized pieces is slightly larger than the diameter of the cylindrical longitudinal member. There are also third specialized pieces representing layers of jelly, which are shaped like a layer of peanut butter spread onto a piece of sandwich bread and have a circular aperture in the center. The diameter of the aperture in the third specialized pieces being slightly larger than the diameter of the cylindrical longitudinal member. Finally, the board game includes a means for determining the number of spaces a playing piece may be moved in any given turn.

While the peanut butter and jelly with milk board game discussed above provides for the use of ingredients for a peanut butter and jelly sandwich, an alternate embodiment, provides playing hamburger ingredient pieces similar to the peanut butter and jelly game but which are shaped and/or colored to resemble a hamburger patty, mustard, catsup, pickles, tomato, bacon, onions, mayo, and a bun or bread. Further, areas of the game board resemble those ingredients which are stationed in those board areas as the game is played. The method of play is basically the same as with the peanut butter and jelly game, which is discussed alter in the specification.

Still another alternate embodiment provides playing pieces similar to the peanut butter and jelly game but which are shaped and/or colored to resemble a pizza pie, including a dough base, pizza sauce, cheese, and other ingredients such as sausage, hamburger, ham, Canadian bacon, pepperoni, peppers, onions, and the like. Further, areas of the game board resemble those ingredients which are stationed in those board areas as the game is played. Again, the method of play is basically the same as with the peanut butter and jelly game.

It is an object of the present invention to provide a board game utilizing playing pieces used to build a simulated peanut butter and jelly sandwich.

It is another object of the present invention to provide a board game which is used to help teach and reinforce the act of counting in young learners while providing amusement and stimulating strategy and competition.

It is another object of the present invention to provide a board game having a course layout containing colored space wherein some of the spaces are color coded spaces which when landed on enable a player to add a constituent of a peanut butter and jelly sandwich to a playing piece wherein yellow corresponds to a piece of bread, brown corresponds to a layer of peanut butter and purple corresponds to a layer of jelly. Spaces of colors other than yellow, brown or purple constitute spaces which only serve to make the rectangular path longer, but do not correspond to any sandwich elements.

It is another object of the present invention to provide a board game having specialized board areas corresponding to a start space and a glass of milk, and additional areas for the storage of special pieces representing pieces of bread, layers of peanut butter, and layers of jelly.

It is another object of an alternate embodiment to require the specialized pieces be obtained in a selected order to build the sandwich, pizza, or burger.

It is another object of the present invention to provide a board game wherein the specialized board areas corresponding to a piece of bread, peanut butter, jelly and a glass of milk are shaped and colored to have the appearance of a piece of bread, peanut butter, jelly and a glass of milk, respectively.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

The Peanut Butter and Jelly with Milk Game for two to six players having recommended ages of four and above. The winner of the game is the first player to assemble a peanut butter and jelly sandwich on that player's playing piece and to advance that playing piece to the winning space on the board which represents a glass of milk.

The components of the Peanut Butter and Jelly with Milk Game of the present invention are manufactured from readily available materials and is simple in design. The game board is composed of fiberboard, wood, paper, paste board, or plastic. The game pieces are comprised of metal, wood, paste board, or plastic.

Figure 1:
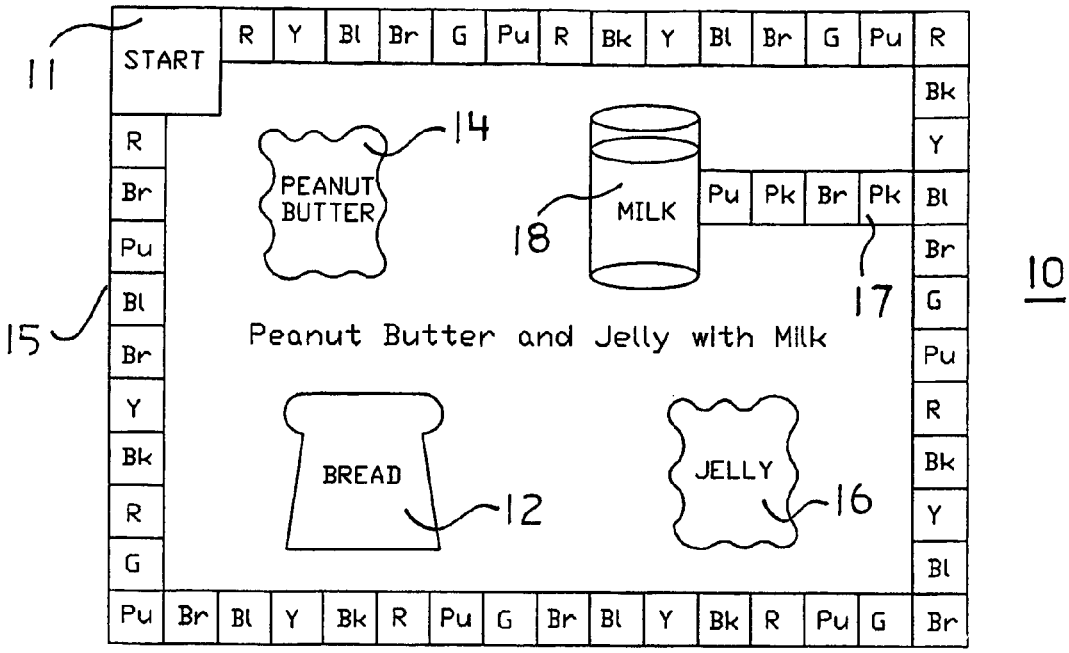
FIG. 1 is a top view of the peanut butter and jelly game playing board.
Figure 2:
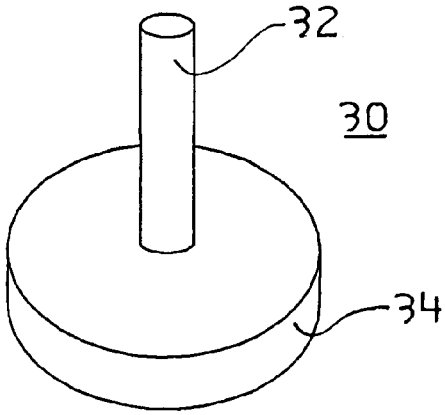
FIG. 2 is perspective view of a playing piece.
Figure 3:
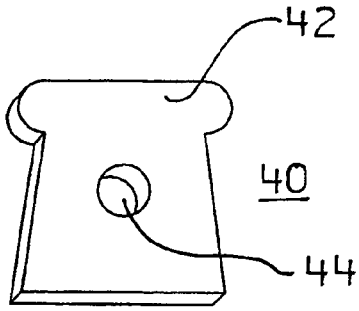
FIG. 3 is a perspective view of a special piece representing a piece of bread.
Figure 4:
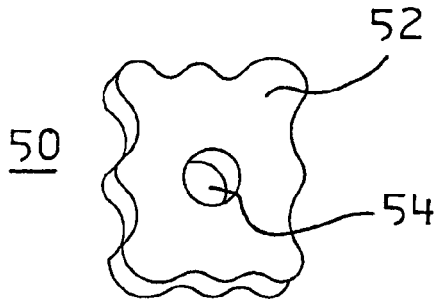
FIG. 4 is a perspective view of a special piece representing a layer of peanut butter.
Figure 5:
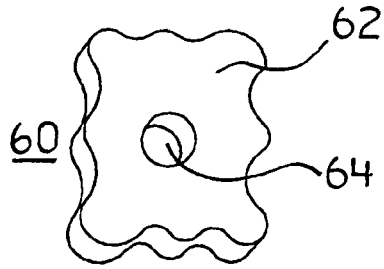
FIG. 5 is a perspective view of a special piece representing a layer of jelly.

A preferred embodiment of the present invention is shown in FIGS. 1-5. A Peanut Butter and Jelly with Milk Game board 10 is shown in FIG. 1. A rectangular circuit 15 of square color coded spaces is laid out around the edge of the board. A Start space 11 is located in the upper left hand corner of board 10. Rectangular circuit 15 includes white Start space 11, eight red square spaces, seven yellow square spaces, seven blue square spaces, eight brown square spaces, six green square spaces, seven purple square spaces, and six black square spaces. Four special areas of the board, located inside rectangular circuit 15 include a bread area 12 where special pieces which represent a piece of bread are stored, a peanut butter area 14 where special pieces which represent a layer of peanut butter are stored, a jelly area 16 where special pieces which represent a layer of jelly are stored and a glass of milk area 18 which is the space on which a player's piece including a completed sandwich must land to win the game. These four special areas are color coded as follows: bread area 12 is yellow, peanut butter area 14 is brown, jelly area 16 is purple and glass of milk area 18 is white. An exit path 17 leading away from circuit 15 flows out of the left hand side of the fourth space down from the upper left hand corner. Exit path 17 includes a purple square space, a brown square space and two pink square spaces. At the end of exit path 17 is glass of milk area 18. Because a playing piece must have a completed sandwich before entering exit path 17, the brown and purple spaces in exit path 17 don't allow the addition of peanut butter or jelly pieces to a playing piece.

All of the square colored spaces in rectangular path 15 are colored one of the following colors: yellow, brown, purple, blue, green, black, and red. When a player's playing piece lands on a yellow colored space and if that player needs to do so, that player may add a special piece corresponding to a piece of bread, which may be obtained from area 12 on board 10, to that player's playing piece. When a player's playing piece lands on a brown colored space and if that player needs to do so, that player may add a special piece corresponding to a layer of peanut butter, which may be obtained from area 14 on board 10, to that player's playing piece. When a player's playing piece lands on a purple colored space and if that player needs to do so, that player may add a special piece corresponding to a layer of jelly, which may be obtained from area 16 on board 10, to that player's playing piece. Therefore, spaces colored yellow, brown and purple are color coded but spaces of other colors are included as fillers for path 15, don't have any special meaning and are therefore considered non-color coded.

There are six playing pieces 30, each of which comprises a base 34, which is disc shaped, with a cylindrical longitudinal member 32 extending upward from the center of base 34. The diameter of cylindrical member 32 is approximately one fourth the diameter of disc shaped base 34. Base 34 is sized so that is fits within the spaces on board 10. The six playing pieces are distinguished by color, with those colors being red, yellow, green, black, blue and white. It is anticipated that the base and the longitudinal member could be square or any other polygonal shape if desired. Specialized playing pieces are configured to be added onto playing pieces 30 by fitting the specialized pieces over and down onto cylindrical member 32. Specialized piece 40 comprises a planar member 42 shaped like a piece of bread with a hole 44 in the center. The diameter of hole 44 is slightly larger than the diameter of cylindrical member 32, thereby allowing piece 40 to be slipped down over member 32 of piece 30. Specialized piece 50 comprises a planar member 52 which has a curvilinear perimeter and includes a hole 54 in the center. Specialized piece 60 comprises a planar member 62 which has a curvilinear perimeter with a hole 64 in the center. As with hole 44, holes 54 and 64 have a diameter slightly large than the diameter of cylindrical member 32 so that pieces 50 and 60 may be slipped down onto piece 30. The thickness of pieces 40, 50 and 60 are approximately one tenth of the diameter of base 30.

In preparation to play, board 10 is placed on a selected playing surface such as a table. Six peanut butter pieces 50 which are brown in color, are placed in a pile in peanut butter area 14 of board 10. Twelve bread pieces 40, which are yellow in color, are placed in a pile in bread area 12 of board 10. Finally, six jelly pieces 60, which are purple in color, are placed in jelly area 16 of board 10. If there are fewer than six players, there may be fewer pieces in areas 12, 14 and 16 but there should be two bread pieces 40, one peanut butter piece 50 and one jelly piece 60 for each player.

Figure 6:
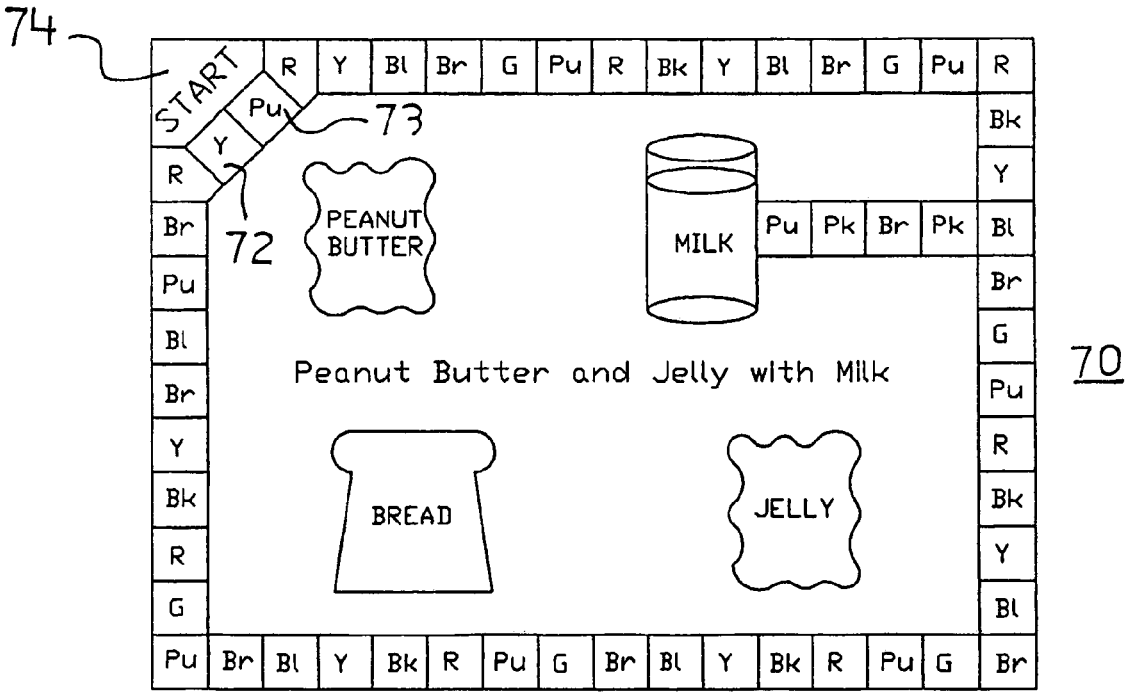
FIG. 6 is a top view of another embodiment of the peanut butter and jelly game playing board.
Figure 7:
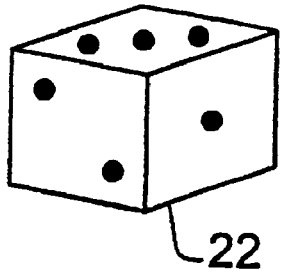
FIG. 7 is a perspective view of a rolling die.
Figure 8:
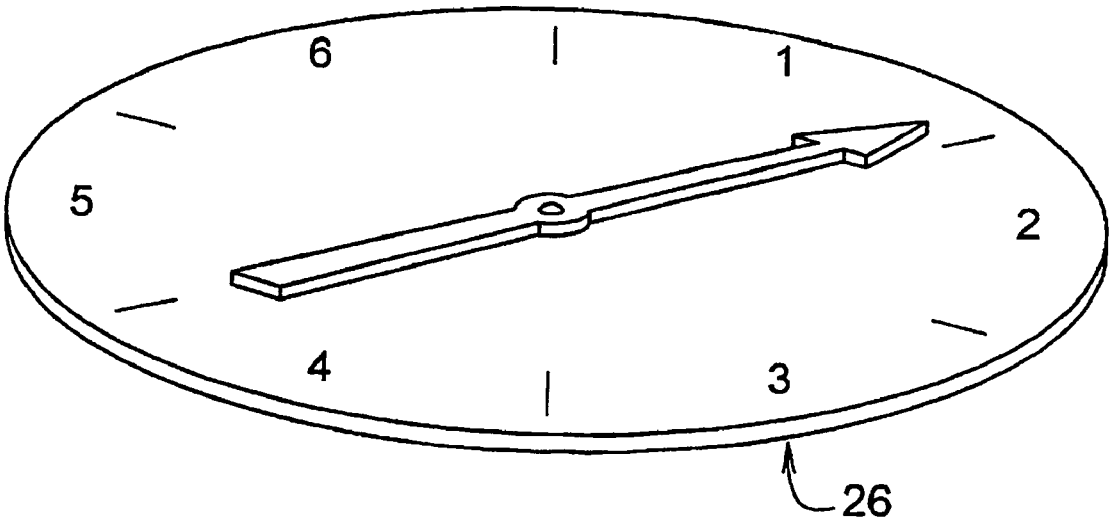
FIG. 8 is a perspective view of a spinner.

To begin the game, each player selects one of the six different colored playing pieces and places that playing piece on Start space 11. It is contemplated that the players may take turns rolling a die 22 as shown in FIG. 6 or spinning a spinner 26 such as shown in FIG. 7 to determine the number of spaces that a playing piece may be moved. Therefore, for the purposes of the following explanation, it is understood that the roll of a die 22 is equivalent to the spin of a spinner 26, either of which is a means to determine the number of spaces to move a playing piece. The player to take the first turn is determined by rolling a die 22 and obtains the highest or lowest score as decided by the players before the die 22 is thrown or an option would be for the youngest player to take the first turn and the next turn is taken by the next player rotating clockwise.

The first player rolls die 22 and moves that player's playing piece 30 from Start space 11, going clockwise, by the number of spaces which appear on top of the die after the roll. If piece 30 lands on a yellow square, that player may take a bread piece from the stack of pieces 40 in bread area 12 on board 10. The player aligns the hole in bread piece 40 with the top of cylinder 32 on that player's playing piece 30 and slides piece 40 down cylinder 32 until piece 40 comes to rest on base 34. However, if that player's playing piece lands on any color other than yellow, that player must wait until the other players have had a turn.

Now, after the first player's turn, the next player to play is the player to the first players left, and so forth, so that play proceeds to player clockwise around the table. The next player follows the same routine as the first player. Players take turns clockwise around the table. To assemble the sandwich, a player's playing piece must first land on yellow to get a slice of bread, then on brown to get a layer of peanut butter, then on purple to get a layer of jelly, and finally on yellow again, to get the final piece of bread. As the players playing pieces land on the correct colors, the players assemble the bread, peanut butter and jelly pieces onto the player's playing pieces. Player's must advance their playing pieces around the board as many times as are necessary to assemble the sandwich with the pieces in the order prescribed above.

Once the sandwich is complete, a player's playing piece, with the complete sandwich assembled thereon, must be advanced toward exit path 17.

The color of the square spaces within exit path 17 is not meaningful since the sandwich must be completed before the playing piece may be advanced into exit path 17.

In order to win, the player must roll the exact number to move the playing piece into exit path 17 and onto the glass of milk space 18. If the playing piece ends up on any of the square spaces within the exit path, then that player must wait for a subsequent turn or turns and continue to roll the die until the exact number comes up to move the playing piece and land exactly on glass of milk area 18. The first player to land on glass of milk area 18 is the winner.

An alternate embodiment of the peanut butter and jelly with milk game board is shown in FIG. 6. Game board 70 differs from game board 10 only in that once a playing piece has left the Start space 74, that piece then will not land on Start space 74 again but rather follow spaces 72 and 73 instead.

In another embodiment, an optional move would be for the player who rolled the dice and move and land on another person's space, the dice rolling player would have the option of moving his piece forward or back one space. Because the peanut butter or jelly would be available in the adjacent spaces. If these optional spaces were of no benefit to the dice rolling player he would have the option of making the player already on the rolled space move forward or backward one space.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A peanut butter and jelly with milk board game comprising:

a game board having a rectangular path of colored spaces including color coded spaces and non-color coded spaces, a start space and a winner's space shaped and colored to resemble a glass of milk, said board including holding areas for specialized pieces representing sandwich parts, and an exit path leading to said winner's space;

six playing pieces, each of said playing pieces including a disc shaped base member and a cylindrical longitudinal member extending coaxially upward from the center of said base member, the diameter of said cylindrical member being approximately one fourth the diameter of said disc shaped base member, said disc shaped member having a thickness of between one eighth and one fourth of the diameter of said disc;

first specialized pieces representing pieces of bread, said first pieces being shaped like a piece of sandwich bread and having formed therein a circular aperture, the diameter of said aperture in said first specialized pieces being slightly larger than the diameter of said cylindrical longitudinal member;

second specialized pieces representing layers of peanut butter, said second pieces being shaped like a layer of peanut butter spread onto a piece of sandwich bread and having formed therein a circular aperture, the diameter of said aperture in said second specialized pieces being slightly larger than the diameter of said cylindrical longitudinal member;

third specialized pieces representing layers of jelly, said third pieces being shaped like a layer of peanut butter spread onto a piece of sandwich bread and having formed therein a circular aperture, the diameter of said aperture in said third specialized pieces being slightly larger than the diameter of said cylindrical longitudinal member;

means for determining the number of spaces a playing piece may be moved in any given turn;

said first specialized pieces, said second specialized pieces and said third specialized pieces capable of being combined in a selected order onto any one of said six playing pieces by placing said aperture of selected ones of said specialized pieces over said cylindrical longitudinal member extending coaxially upward from the center of said base member of a selected one of said six playing pieces, thus assembling a simulated sandwich; and selected ones of said six playing pieces capable of being moved, along with said specialized pieces assembled thereon, from one selected said colored space to another selected said colored space on said rectangular path.

2. The peanut butter and jelly with milk board game of claim 1 wherein said holding areas for specialized pieces representing sandwich parts contain boarders resembling a perimeter of a piece of sandwich bread, a layer of peanut butter spread on a piece of sandwich bread and a layer of jelly spread on a piece of sandwich bread.

3. The peanut butter and jelly with milk board game of claim 1 wherein said holding areas for specialized pieces representing sandwich parts are yellow in color, said holding areas for specialized pieces representing a layer of peanut butter spread on a piece of sandwich bread are brown in color, and said holding areas for specialized pieces representing a layer of jelly spread on a piece of sandwich bread are purple in color.

4. The peanut butter and jelly with milk board game of claim 1 wherein said means for determining the number of spaces a playing piece may be moved in any given turn is selected from the group consisting of a die and a spinner.

5. The peanut butter and jelly with milk board game of claim 1 wherein said color coded spaces within said rectangular path include yellow, brown, and purple spaces wherein any one of said yellow spaces enables a playing piece landing thereon to have one of said first specialized pieces representing pieces of bread added thereto, any one of said brown spaces enables a playing piece landing thereon to have one of said second specialized pieces representing layers of peanut butter added thereto, and any one of said purple spaces enables a playing piece landing thereon to have one of said first specialized pieces representing layers of jelly added thereto.

6. A peanut butter and jelly with milk board game comprising:

a game board having a rectangular path of colored spaces including color coded spaces and non-color coded spaces, a start space and a winner's space shaped and colored to resemble a glass of milk, said board including holding areas for specialized pieces representing sandwich parts, and an exit path leading to said winner's space, said holding areas for specialized pieces representing sandwich parts include boarders resembling a perimeter of a piece of sandwich bread, a layer of peanut butter spread on a piece of sandwich bread and a layer of jelly spread on a piece of sandwich bread, said holding areas for specialized pieces representing sandwich parts being yellow in color, said holding areas for specialized pieces representing a layer of peanut butter spread on a piece of sandwich bread being brown in color, and said holding areas for specialized pieces representing a layer of jelly spread on a piece of sandwich bread being purple in color;

said color coded spaces within said rectangular path include yellow, brown, and purple spaces wherein any one of said yellow spaces enables a playing piece landing thereon to have one of said first specialized pieces representing pieces of bread added thereto, any one of said brown spaces enables a playing piece landing thereon to have one of said second specialized pieces representing layers of peanut butter added thereto, and any one of said purple spaces enables a playing piece landing thereon to have one of said first specialized pieces representing layers of jelly added thereto;

six playing pieces, each of said playing pieces including a disc shaped base member and a cylindrical longitudinal member extending coaxially upward from the center of said base member, the diameter of said cylindrical member being approximately one fourth the diameter of said disc shaped base member;

first specialized pieces representing pieces of bread, shaped like a piece of sandwich bread and having formed therein a circular aperture, the diameter of said aperture in said first specialized pieces being slightly larger than the diameter of said cylindrical longitudinal member;

second specialized pieces representing layers of peanut butter, shaped like a layer of peanut butter spread onto a piece of sandwich bread and having formed therein a circular aperture, the diameter of said aperture in said second specialized pieces being slightly larger than the diameter of said cylindrical longitudinal member;

third specialized pieces representing layers of jelly, shaped like a layer of peanut butter spread onto a piece of sandwich bread and having formed therein a circular aperture, the diameter of said aperture in said third specialized pieces being slightly larger than the diameter of said cylindrical longitudinal member; and means for determining the number of spaces a playing piece may be moved in any given turn;

said first specialized pieces, said second specialized pieces and said third specialized pieces capable of being combined in a selected order onto any one of said six playing pieces by placing said aperture of selected ones of said specialized pieces over said cylindrical longitudinal member extending coaxially upward from the center of said base member of a selected one of said six playing pieces, thus assembling a simulated sandwich onto said selected one of said six playing pieces; and said selected one of said six playing pieces capable of being moved, along with said specialized pieces assembled thereon, from one selected said colored space to another selected said colored space on said rectangular path.

* * * * *